United States Patent [19]

Sanchez, III

[11] Patent Number: 5,000,289

[45] Date of Patent: Mar. 19, 1991

[54] EXTENDABLE STEP LADDER

[76] Inventor: Jose Sanchez, III, 5346 Maple Vista, San Antonio, Tex. 78247

[21] Appl. No.: 526,390

[22] Filed: May 21, 1990

[51] Int. Cl.[5] ..... E06C 1/22

[52] U.S. Cl. ..... 182/167; 182/209

[58] Field of Search ..... 182/167, 166, 207, 210, 182/209

[56] References Cited

U.S. PATENT DOCUMENTS

| | | | |
|---|---|---|---|
| 137,040 | 3/1873 | Walker | 182/167 |
| 318,391 | 5/1885 | Price | 182/207 |
| 492,992 | 3/1893 | Poertner | 182/167 |
| 737,636 | 9/1903 | Latta | 182/167 |
| 745,320 | 12/1903 | Bruno | 182/167 |
| 806,501 | 12/1905 | Rouse | 182/167 |
| 860,065 | 7/1907 | Scott | 182/207 |
| 1,269,142 | 6/1918 | Wilcke | 182/166 |
| 1,359,297 | 11/1920 | Voss | 182/207 |
| 1,401,257 | 12/1921 | Houghtaling | 182/167 |
| 1,495,197 | 5/1924 | Oakley | 182/166 |
| 2,127,949 | 8/1938 | Zeman | 182/166 |
| 2,147,991 | 2/1939 | Rusby | 182/209 |
| 2,975,857 | 3/1961 | Suroff et al. | 182/207 |
| 4,039,047 | 8/1977 | Larson | 187/111 |
| 4,210,224 | 7/1980 | Kummerlin et al. | 182/207 |
| 4,854,420 | 8/1989 | Juang | 182/207 |

*Primary Examiner*—Reinaldo P. Machado
*Attorney, Agent, or Firm*—Gunn, Lee & Miller

[57] ABSTRACT

A folding step ladder of multipart construction that is extendable from a standard base height to a series of heights incrementally greater than the standard base height, and that is composed of four ladder elements; an upper-front element joined to an upper-rear element at a top hinge-step, a lower-front element slidingly joined to the upper-front element along its length, and a lower-rear element slidingly joined to the upper-rear element along its length. The lower elements captively slide along the length of their corresponding upper element and are capable of being held at a particular incremental extension by a latch arrangement that engages the upper element when downward force is exerted on the ladder.

5 Claims, 3 Drawing Sheets

EXTENDABLE STEP LADDER

BACKGROUND OF THE INVENTION

1. Field of the Invention:

This invention relates generally to ladders capable of supporting a single human, and more specifically to a folding step ladder capable of being extended incrementally to a variety of heights.

2 . Description of the Related Arts:

Ladders that are capable of supporting a single person have in the past generally fallen into one of two broad categories commonly referred to as "step" ladders and "straight" ladders. Step ladders are characterized by their ability to be self supporting, which is in contrast to the requirement that straight ladders have an external support of some type. The external support for a straight ladder is generally provided for by leaning the ladder against a stable vertical structure. Straight ladders are frequently constructed as "extension" ladders of some form that are capable of adjusting to a variety of lengths depending upon the needs of the user. Step ladders are utilized more frequently in the interior of buildings or other structures where heights have upper limitations determined by the ceiling or roof of the structure. By contrast, straight and extension ladders are more frequently employed on the exterior of structures, or on exterior objects such as trees, fences, etc.

It is clearly advantageous to be able to rely on the self supporting features of a ladder if possible. The problem is that self support generally means adding additional components to the ladder. These supplemental components add bulk, weight, etc., that all contribute to the problems of handling and moving the ladder. On the other hand relying on the availability of an external support for a straight or extension ladder might be equally impractical.

Neither type of ladder can fulfill all the functions of the other type, and so both are commonly utilized and both may be required at any particular job site.

Given that it is an advantage to have some form of self support, it is also very clear that at some point, with a continuous increase in ladder height, the above mentioned problems outweigh the advantages of self support. Within certain height requirements, however, there is no doubt that the self support and stability of a step ladder make it the more practical choice over a straight ladder of comparable height.

Straight ladders have one general advantage over step ladders in that they more easily incorporate extendable components. While the same factors that demand extendable straight ladders would also demand extendable step ladders, the mechanics of creating extendable step ladders has always been more complex than that for straight ladders.

Step ladders are most frequently used in indoor situations and are constructed in standard heights that range from two feet to ten feet. There are larger step ladders being manufactured but after about ten feet in height the lateral stability of the ladder diminishes. The most common heights are six, eight, and ten foot ladders.

Because an extendable step ladder is inherently more complex than an extendable straight ladder the industry's solution has been to simply provide more than one size of ladder. While this may indeed simplify the structure of any individual ladder it creates a number of new problems. It is not unusual for those who frequently use step ladders to maintain a variety of different ladders of varying heights for just such different applications. The necessity of purchasing and transporting a plurality of different step ladders to meet the requirements of various applications often proves costly and cumbersome.

An unfortunate by-product of the necessity of having a variety of step ladder sizes results when users are reluctant to switch ladders when a taller height is required. More often then not the worker faced with a momentary task at a greater height will attempt to reach that height by standing on the top hinge step of the ladder. Needless to say this is potentially very dangerous. Were it easier to provide the ladder height needed workers would be less inclined to "stretch" the reach capabilities of an otherwise appropriate step ladder.

It would be advantageous to combine the self support and stability of the step ladder with the extendibility found in many straight ladders. If a single step ladder could fulfill the function of a six foot ladder and an eight foot ladder, and not have the cost or the bulk of two separate ladders, then many of the above described problems could be solved.

There are extendable step ladders designs that are known and have been employed in the past. These designs, however, all suffer from high cost and complexity. Some of these designs try to do too much, i.e. try to provide heights variable over too great a range. Some of these are overly complex, and thus costly, because they attempt to provide an infinitely variable height rather than an incrementally variable height. Still other designs obtain suitable results only at the expense of great additional bulk and weight.

SUMMARY OF THE INVENTION

This invention provides solutions to the shortcomings of the previous designs. The present invention provides the advantages of extendable ladders, without sacrificing the convenience of ordinary step ladders, in a configuration that is structurally stable and mechanically simple.

It is an object of this invention to provide a ladder capable of being self supporting capable of variations in height.

It is a further object of this invention to provide an extendable step ladder that is of relatively simple construction. It is a further object of this invention to provide an extendable step ladder that minimizes weight and cost relative that of an ordinary step ladder.

It is also an object of this invention to provide an extendable step ladder that is capable of incremental variations in height, is of simple construction, minimal additional weight, minimal additional manufacturing cost, and is structurally as sound as a non-extendable step ladder.

Further objects of this invention will be apparent from the following descriptions and from the drawing.

DESCRIPTION OF THE PREFERRED EMBODIMENTS

Figure 1:
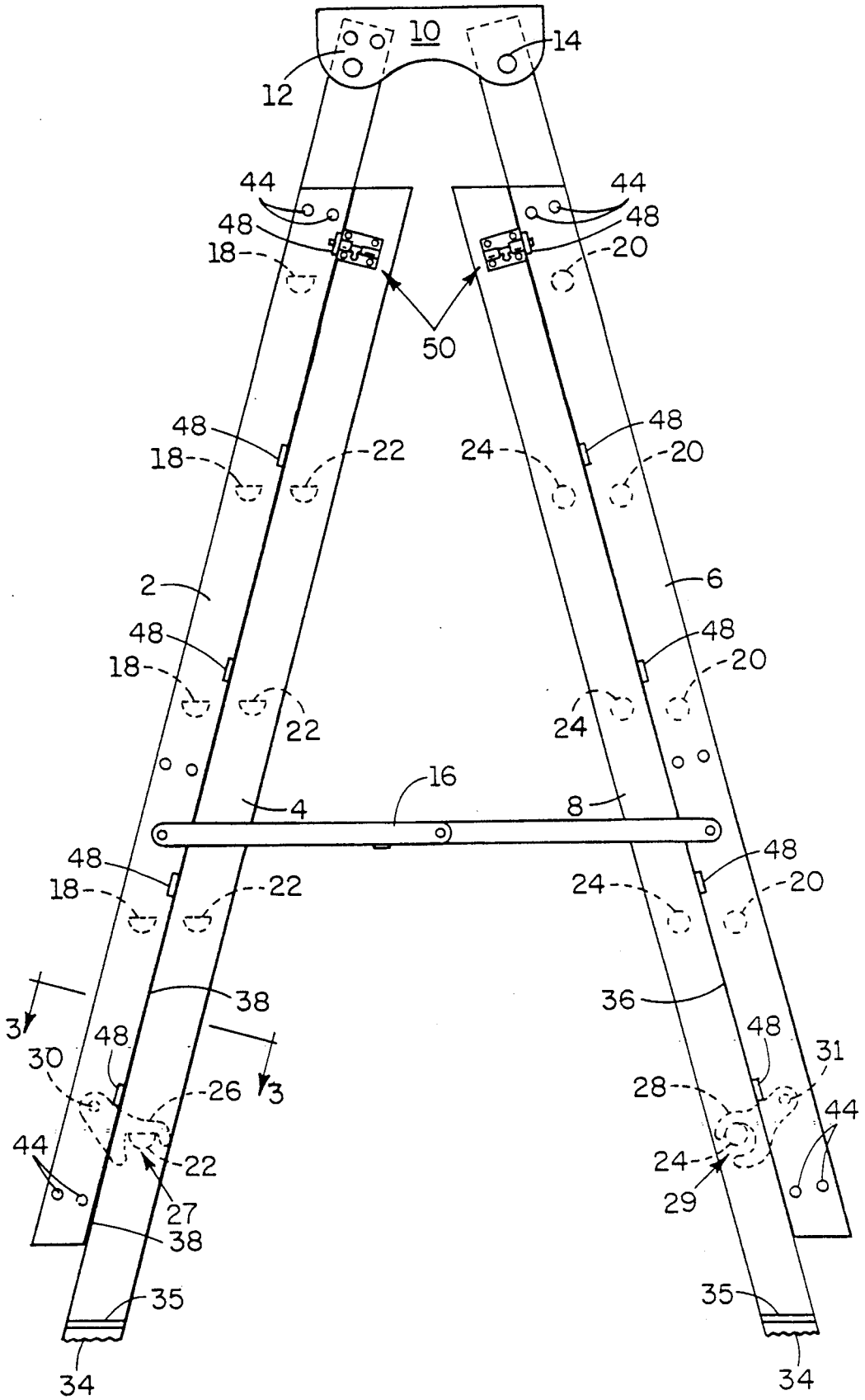
FIG. 1 is a side elevational view of the preferred embodiment of the present invention in a non-extended configuration.

Reference is now made to FIG. 1 for a detailed description of one embodiment of the design of the present invention. It should be understood that though much of the description herein refers to the side of the ladder seen in the drawing, these descriptions apply equally to the mirror image opposite side of the ladder not shown. Except where indicated, every feature of one side of the ladder is duplicated on the opposite side.

The preferred embodiment is comprised of four basic ladder elements. Upper-front ladder element 2 is slidingly attached to lower-front ladder element 4. Upper-rear ladder element 6 is slidingly attached to lower-rear ladder element 8. In the embodiment shown in the drawing, ladder elements 2, 4, 6, and 8 are constructed of wood. Alternately the ladder elements described may be constructed of aluminum or fiberglass, as is typical in the industry, or of an extruded rigid polymer material. Each of the upper ladder elements 2 and 6 have as part of their structure upper slide rails 40, which interlock, in a manner more thoroughly described below, with lower slide rails 42 which are part of the structure of lower ladder elements 4 and 8. These interlocking rails 40 and 42 are made of metal in the preferred embodiment and are attached to their respective ladder elements 2, 4, 6, and 8 by means of rivets 40. This arrangement is described in more detail in relation to FIG. 3.

The front ladder elements 2 and 4 are first attached to the rear ladder elements 6 and 8, by way of hinge step 10. Hinge step 10 is rigidally connected to upper-front ladder element 2 by way of front hinge step rivets 12. Hinge step 10 is pivotally connected to upper-rear ladder element 6 by way of rear hinge step rivets 14. The front ladder elements 2 and 4 are additionally attached to the rear ladder elements 6 and 8 by way of locking hinge 16. Locking hinge 16 is pivotally connected to upper-front ladder element 2 and to upper-rear ladder element 6, and is itself of two part construction and is hinged at its center.

Each ladder element 2, 4, 6, and 8, is of typical ladder construction made up of parallel struts with intermittently spaced steps or cross members. Upper-front ladder element 2 has upper cross mounted steps 18 and lower-front ladder element 4 has lower cross mounted steps 22. Each cross mounted step 18, and 22 has a half circular cross sectional shape. Upper-rear ladder element 6 has upper-rear cross members 20 and lower-rear ladder element 8 has lower-rear cross members 24. Each cross member 20 and 24 has a circular cross sectional shape. Each cross member 20 and 24, and each cross mounted step 18 and 22, are spaced at approximately one foot intervals along each ladder element 2, 4, 6, and 8. In the preferred embodiment there are five (5) upper cross mounted steps 18 on upper-front ladder element 2, five (5) upper-rear cross members 20 on upper-rear ladder element 6, four (4) lower cross mounted steps 22 on lower-front ladder element 4, and four (4) lower-rear cross members 24 on lower-rear ladder element 8.

To immobilize upper-front ladder element 2 in relation to lower-front ladder element 4, front locking catch 26 is pivotally mounted on the lower end of upper-front ladder element 2. Front locking catch 26 is attached to upper-front ladder element 2 by way of front locking catch axle 30. Front locking catch 26 has an open jaw 27 that engages lower cross mounted steps 22 mounted on lower-front ladder element 4.

To immobilize upper-rear ladder element 6 in relation to lower-rear ladder element 8, rear locking catch 28 is pivotally mounted on the lower end of upper-rear ladder element 6. Rear locking catch 28 is attached to upper-rear ladder element 6 by way of rear locking catch axle 31. Rear locking catch 28 has an open jaw 29 that engages lower-rear cross members 24 mounted on lower-rear ladder element 8.

While locking catches 26 and 28 provide the proper immobilization of the ladder when a normal downward force is exerted (as when an individual is standing on a step of the ladder), they do not immobilize the ladder elements when an upward force is exerted on the upper ladder elements. Bolt catches 50 are positioned to engage bolt tabs 48 and provide the proper upward immobilization once a ladder position is set. Bolt catches 50 would be disengaged when the ladder is either being extended or collapsed, and would be engaged when the ladder is simply being picked up to be moved from place to place. Because they are required only to bear the load of the lower ladder elements and not the downward loads placed on the ladder, bolt catches 50 need not be as strong as locking catches 26 and 28, and in the preferred embodiment are off the shelf sliding bolt catches of the type typically used for doors and cabinets. Bolt tabs 48 are configured to receive and hold the sliding bolt from bolt catches 50, and in the preferred embodiment are constructed as part of upper slide rails 40 by cutting and bending up a small section of slide rails 40 at appropriate intervals along its length.

The lower end of each lower ladder element 4 and 8, is constructed with an angle appropriate to maximize contact with the surface the ladder is placed on. To aid in the stabilization of the ladder, friction pads 34 are placed on the lower end of each lower ladder element 4 and 8.

To facilitate the extension of the ladder, foot pads 35 are attached to lower ladder elements 4 and 8. Foot pads 35 are flat tabs in the preferred embodiment that extend outward to the side from ladder elements 4 and 8 in a manner that allows the user to step upon them and hold down ladder elements 4 and 8 while ladder elements 2 and 6 are being lifted for extenstion.

Figure 2:
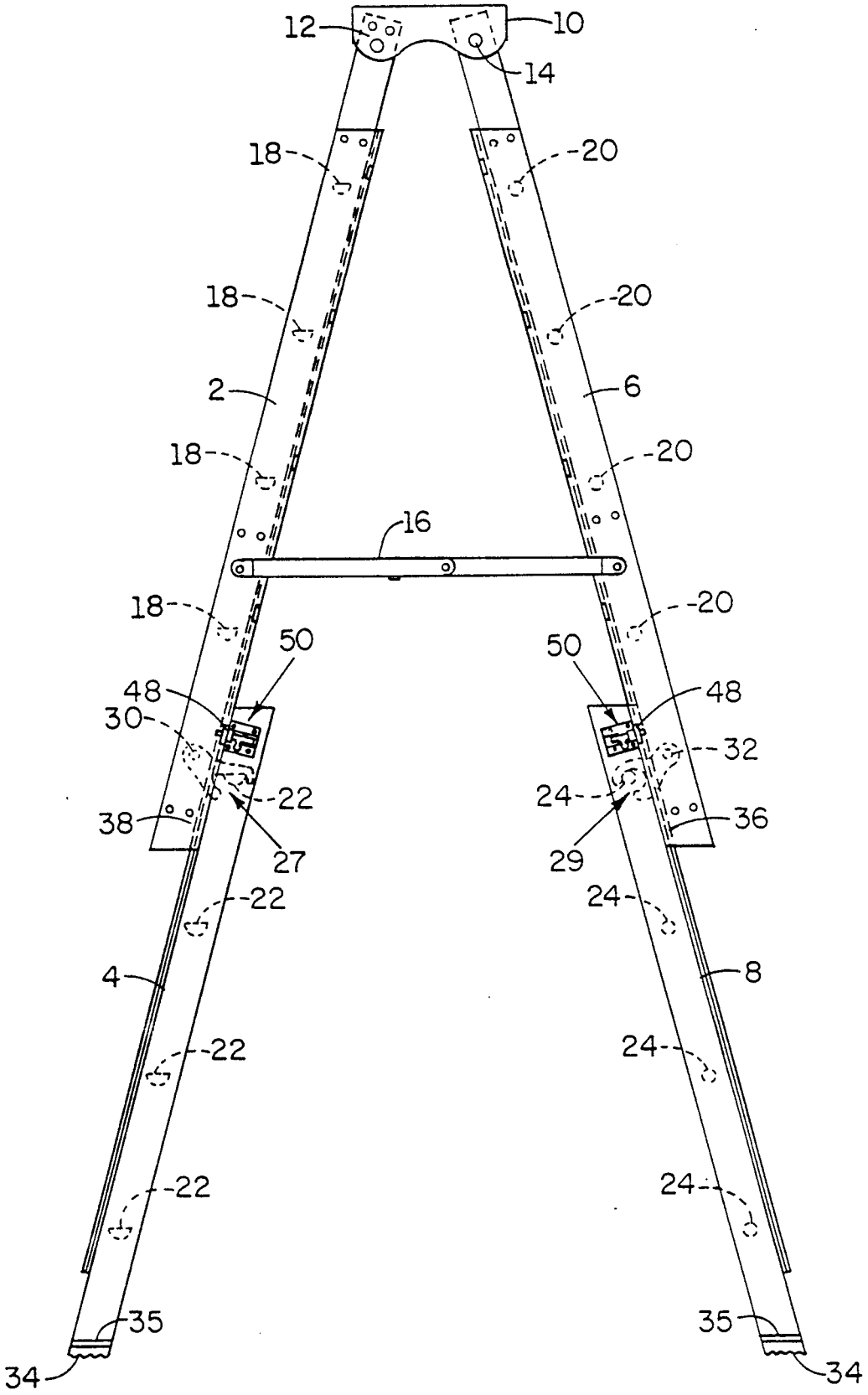
FIG. 2 is a side elevational view of the preferred embodiment of the present invention in an extended configuration.

FIG. 2 shows the preferred embodiment of the invention in its extended configuration.

No additional components are disclosed in FIG. 2, but the position of the ladder elements 2, 4, 6, and 8, relative to each other has been altered.

Upper-front ladder element 2 is displaced along lower-front ladder element 4 such that the lower end of upper-front ladder element 2 is now adjacent to the upper end of lower-front ladder element 4, thereby forming a front upper-lower overlap 38 sufficient to maintain ladder elements 2 and 4 in stable attachment. Upper-rear ladder element 6 is displaced along lower-rear ladder element 8 such that the lower end of upper-rear ladder element 6 is now adjacent to the upper end of lower-rear ladder element 8, thereby forming a rear upper-lower overlap 36 between adjacent ladder elements 6 and 8 sufficient to provide a stable rear support for the ladder.

Front locking catch 26 engages the uppermost lower cross mounted step 22 of lower-front ladder element 4 and rear locking catch 28 engages the uppermost lower cross member 24 of lower-rear ladder element 8. The extended step ladder which in the preferred embodiment of FIG. 1 was on the order of six (6) feet in height, is extended to a height of approximately nine (9) feet in the configuration shown in FIG. 2. The configuration can be seen to be variable upon any of the lower cross mounted steps 22 and upon the lower cross members 24. In the preferred embodiment shown in FIG. 1 and FIG. 2 the configuration could be altered to provide two intermediate heights corresponding to the middle two of four lower cross mounted steps 22 and the middle two of four lower cross members 24. These configurations would correspond with heights of seven and eight feet respectively.

After locking catches 26 and 28 are engaged, bolt catches 50 are engaged to the lowest bolt tab 48 on each appropriate upper ladder element 2 and 6. This allows the ladder to be picked up and moved without the displacement of the various ladder elements.

Figure 3:
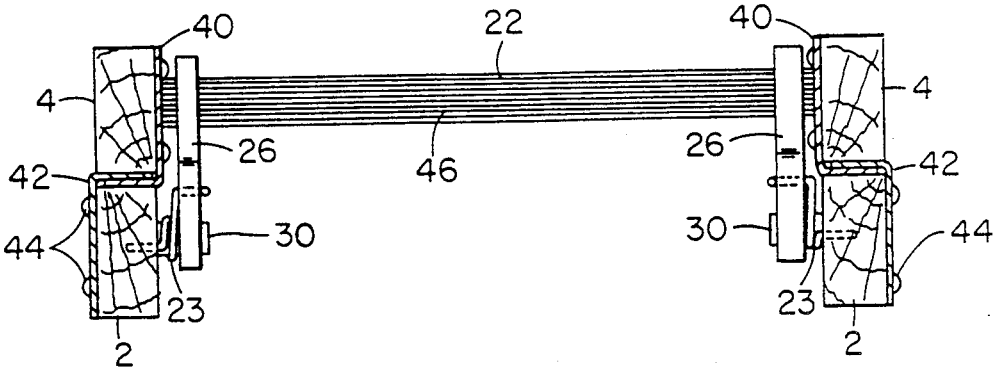
FIG. 3 is a detailed cross-sectional view along line 3—3 of FIG. 1.

FIG. 3 is a cross sectional view of the front ladder elements 2 and 4, seen along section line 3—3 shown in FIG. 1. The ladder elements 2 and 4 are seen in their rectangular cross sectional shape. Ladder steps 18 and 22 have serrated surfaces 46 to prevent the users foot from slipping off.

On the outside faces of upper-front ladder element 2 are mounted upper slide rails 42. These upper slide rails 42 are attached by means of rivets 44 to the upper-front ladder elements 2, and as shown in the preferred embodiment are made up of lengths of 90 degree angle metal channel. These upper slide rails 42 are oriented so that they are attached to and cover the outside faces of the upper-front ladder elements 2, and cover but are spaced from the rear faces of the ladder elements 2 between upper-front ladder elements 2 and lower-front ladder elements 4.

On the inside faces of lower-front ladder element 4 are mounted lower slide rails 40. These lower slide rails 40 are attached by means of rivets 44 to the lower-front ladder element 4, and as shown in the preferred embodiment are also made up of lengths of 90 degree angle metal channel. These lower slide 40 are oriented so that they are attached to the inner side faces of the lower-front ladder elements 4, and cover but are spaced from the front faces of the ladder elements 4 between lower-front ladder elements 4 and upper-front ladder elements 2. Upper slide rails 42 captively overlap lower slide rails 40 in the space between upper-front ladder element 2 and lower-front ladder element 4.

In the above described arrangement the upper ladder element 2 is free to slide along the length of lower ladder element 4 while still being captively held adjacent to lower ladder element 4. In the preferred embodiment the surfaces of lower slide rails 40, upper slide rails 42, upper ladder element 2, and lower ladder element 4 are all appropriately lubricated to facilitate the movement of upper ladder element 2 along lower ladder element 4.

In another preferred embodiment described above that utilizes aluminum rather than wooden ladder elements, the slide rails 40 and 42 would more appropriately be incorporated into the ladder element strut itself. The fundamental structure, orientation, and function of the slide rails in such an embodiment would still be the same. These aluminum ladder elements would typically be constructed from sections of aluminum "I" beam or aluminum "U" channel. In either case, the slide rails 40 and 42 would comprise one wall of the "I" beam or "U" channel and would interlock with a corresponding wall on another ladder element.

FIG. 3 also discloses the positioning of front locking catches 26 in relation to lower cross mounted steps 22 and upper-front ladder element 2. Locking catches 26 are attached to ladder element 2 by front locking catch axles 30. Locking catches 26 are configured both to swing free of lower cross mounted steps 22 and to alternately engage steps * * * s is discussed below.

The cross sectional view shown in FIG. 3 is specifically drawn to the ladder components associated with the front ladder elements 2 and 4, but appropriately describes similar components that are associated with the rear ladder elements 6 and 8. With the exceptional lack of serrated surfaces on the rear cross members 20 and 24, all the components described in FIG. 3 and above are duplicated in comparable components positioned on rear ladder elements 6 and 8.

Figure 4:
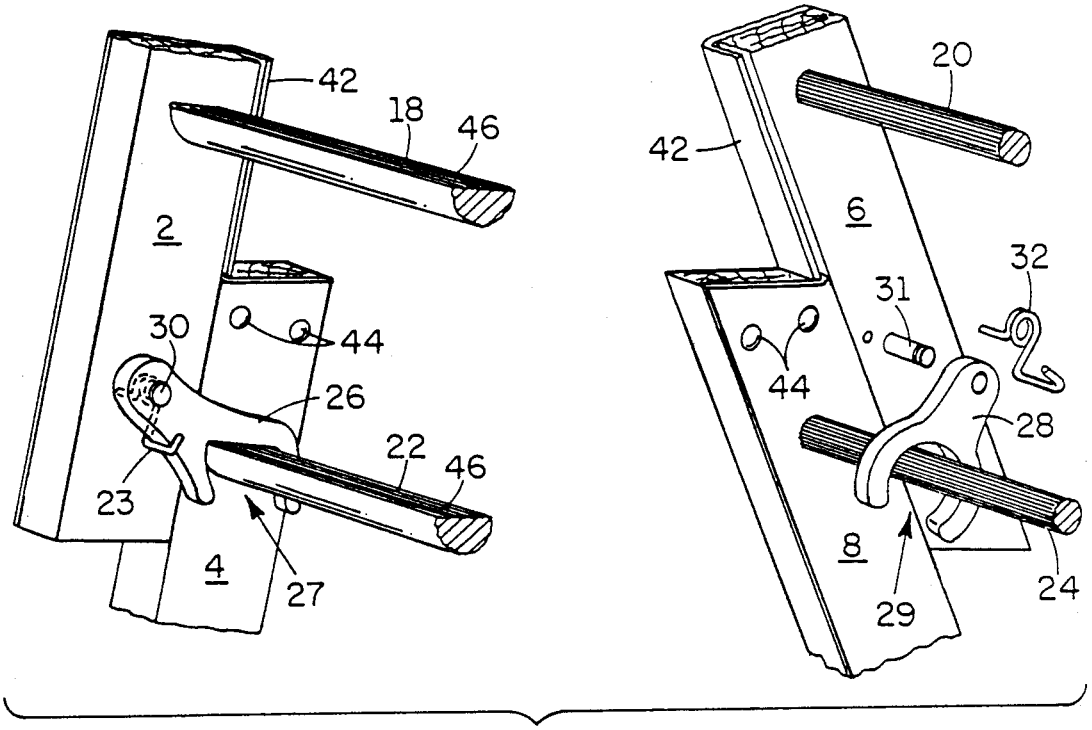
FIG. 4 is a detailed inside view of the locking catch mechanisms shown in FIG. 1 and FIG. 2.

FIG. 4 is a detailed inside view of locking catches 26 and 28. The view additionally explodes the arrangement of rear locking catch 28 to show the placement of its components. Though the view is specifically of one side of the ladder looking out from under it, the functional description is the same for the opposite side as well.

Front locking catch 26 is pivotally mounted, by way of front locking catch axle 30, on upper-front ladder element 2 near its lower end. Front locking catch 26 is free to rotate about locking catch axle 30 under the control of spring 23. As upper-front ladder element 2 is lifted upwards so as to slide along lower-front ladder element 4, front locking catch 26 is forced to rotate downward and out of the way of each lower cross mounted step 22 that it comes in contact with. When a particular height is achieved upper-front ladder element 2 is raised to a point where front locking catch 26 is just above an appropriate step 22. Ladder element 2 is then lowered to the point at which front locking catch jaw 27 engages the above mentioned appropriate step 22. Downward pressure on upper-front ladder element 2, both from the weight of the upper ladder elements 2 and from any person being supported on the ladder, will continue to force the lower cross mounted step 22 into the front locking catch jaw 27. This upward force on front locking catch 26 would tend to rotate front locking catch 26 out of the way if it were not also tending to force ladder elements 2 and 4 apart. Because ladder elements 2 and 4 are captively held adjacent to each other by slide rails 40 and 42, locking catch 26 is prevented from rotating beyond the point where locking catch jaw 27 most completely engages step 22 and "locks" the ladder elements 2 and 4 in place. As long as downward force continues to be exerted, ladder elements 2 and 4 will remain immobilized both transversely and longitudinally with respect to each other. Locking catch spring 23 tends to keep locking catch 26 in a position to receive step 22 from below, unless locking catch 26 is rotated against locking catch spring 23 and out of the way by either contact with a higher step 22 passing from above, or by manual rotation by the user. It is by this latter means that the extended position of the ladder shown in FIG. 2 is returned to the lowered configuration shown in FIG. 1. By manually rotating locking catch 26 out of the way of passing steps 22, upper-front ladder element 2 may be uninteruptably slid down along lower-front ladder element 4 to a collapsed position.

Though the above description pertains specifically to one of two front locking catches 26, the description is also appropriate for each rear locking catch 28, one of which is shown in FIG. 4. The exploded view of rear locking catch 28 shows the placement of rear locking catch spring 32 on rear locking catch axle 31.

The construction of the ladder is such that as long as the ladder is not supporting any objects, the process of collapsing it from an extended position can be safely performed, after disengaging bolt catches 50, by simultaneously lifting slightly on both the front and the back of the ladder, and then simultaneously lowering the upper ladder elements 2 and 6. The entire ladder is capable of being folded while in any extended or collapsed position by simply releasing locking hinge 16 and pivoting rear ladder elements 6 and 8 towards front ladder elements 2 and 4.

The ladder itself is symmetrical across a plane passing perpendicular to steps 18 and cross members 20. All references to components and parts on the portion of the ladder shown in the drawing are equally applicable to similar components and parts on the opposite portion of the ladder.

I claim:

1. An extendable step ladder, comprising:

a first and a second lower ladder element, each of said lower ladder elements comprising two parallel struts laterally connected together by a plurality of intermittently spaced rungs, each of said struts having an upper and a lower end and having a slide rail, said slide rail extending along a length of said strut;

a first and a second upper ladder element, each of said upper ladder elements comprising two parallel struts laterally connected together by a plurality of intermittently spaced rungs, each of said struts having an upper and a lower end and having a slide rail, said slide rail extending along a length of said strut, said slide rails of said upper ladder elements engaging said slide rails of said lower ladder elements so as to allow said upper and lower ladder elements to captively slide relative to one another;

a first and a second catch assembly, each of said catch assemblies comprising;

a yoke having a first and a second end, said first end pivotal attached to one of said struts of said first upper ladder element, said second end formed to receive and hold said steps of said first lower ladder element; and a spring having a first and a second end, said spring attached at said first end to said yoke and at said second end to said strut adjacent said yolk, said spring serving to bias said yolk to receive said steps of said first lower ladder element;

a third and a fourth catch assembly, each of said catch assemblies comprising;

a yoke having a first and a second end, said first end pivotally attached to one of said struts of said second upper ladder element, said second end formed to receive and hold said rungs of said second lower ladder element; and a spring having a first and a second end, said spring at said first end to said yoke and at said second end to said strut adjacent said yolk, said spring serving to bias said yolk to receive said rungs of said second lower ladder element;

a first and a second bolt catch, each of said bolt catches having a sliding bolt, said bolt catches being attached one to each of said ladder elements in positions adjacent said slide rails of said lower ladder elements;

a plurality of bolt catch tabs intermittently spaced along each of said upper ladder elements and positioned so as to receive said sliding bolts from each of said bolt catches; and a generally tabular hinge step rigidly attached to said first upper ladder element and pivotally attached to said second upper ladder element so as to allow said second upper ladder element and said second lower ladder element to fold between a position parallel and adjacent to said first upper ladder element and said first lower ladder element, and a position apart from said first upper ladder element and said first lower ladder element.

2. The extendable step ladder of claim 1 further comprising four foot pads, said foot pads attached one to said lower end of each of said struts of each of said lower ladder elements, said foot pads projecting generally perpendicular to said struts and generally parallel to a surface upon which said extendable step ladder is placed, said foot pads capable of being stepped upon in order to hold said lower ladder elements in contact with said surface while said upper ladder elements are being lifted.

3. An extendable step ladder, comprising:

a first and a second lower ladder element, each of said lower ladder elements comprising two parallel struts laterally connected together by a plurality of intermittently spaced rungs, each of said struts having an upper and a lower end and having a slide rail, said slide rail extending along a length of said strut;

a first and a second upper ladder element, each of said upper ladder elements comprising two parallel struts laterally connected together by a plurality of intermittently spaced rungs, each of said struts having an upper and a lower end and having a slide rail, said slide rail extending along a length of said strut, said slide rails of said upper ladder elements engaging said slide rails of said lower ladder elements so as to allow said upper and lower ladder elements to captively slide relative to one another;

means for alternately immobilizing and releasing said upper ladder elements relative to said lower ladder elements;

said slide rails each comprising a channel, said channel comprising a first and a second wall, said first wall positioned generally perpendicular to said second wall, said first wall being attached to a first side of said strut and said second wall being directed to extend across and parallel to a second side of said strut, said second wall being spaced above said second side of said strut a distance sufficient to receive a slide rail of another said ladder element and to be received by a corresponding space created by said slide rail of said other ladder element; and a generally tabular hinge step rigidly attached to said first upper ladder element and pivotally attached to said second upper ladder element so as to allow said second upper ladder element and said second lower ladder element to fold between a position parallel and adjacent to said first upper ladder element and said first lower ladder element, and a position apart from said first upper ladder element and said first lower ladder element.

4. An extendable step ladder, comprising:

a first and a second lower ladder element, each of said lower ladder elements comprising two parallel struts laterally connected together by a plurality of intermittently spaced rungs, each of said struts having an upper and a lower end and having a slide rail, said slide rail extending along a length of said strut;

a first and a second upper ladder element, each of said upper ladder elements comprising two parallel struts laterally connected together by a plurality of intermittently spaced rungs, each of said struts having an upper and a lower end and having a slide rail, said slide rail extending along a length of said strut, said slide rails of said upper ladder elements engaging said slide rails of said lower ladder elements so as to allow said upper and lower ladder elements to captively slide relative to one another;

means for alternately immobilizing and releasing said upper ladder elements relative to said lower ladder elements;

each of said struts being constructed of rigid metal and each of said slide rails comprising flat extensions of said struts, said flat extensions projecting generally perpendicular from said struts so as to form a channel between a first side of each of said struts and said flat extensions, each of said flat extensions being positioned to slidingly contact and engage a flat extension of a strut of another said ladder element placed within said channel; and a generally tabular hinge step rigidly attached to said first upper ladder element and pivotally attached to said second upper ladder element so as to allow said second upper ladder element and said second lower ladder element to fold between a position parallel and adjacent to said first upper ladder element and said first lower ladder element, and a position apart from said first upper ladder element and said first lower ladder element.

5. An extendable step ladder, comprising;

a first and a second lower ladder element, each of said lower ladder elements comprising;

two parallel struts laterally connected together by a plurality of intermittently spaced rungs, each of said struts having a slide face;

two slide rails, one attached to each of said struts, each of said slide rails extending along a length of said strut in a position adjacent said slide face;

a first and a second upper ladder element, each of said upper ladder elements slidingly attached to one of said lower ladder elements, each of said upper ladder elements comprising;

two parallel struts laterally connected together by a plurality of intermittently spaced rungs, each of said struts having an slide face;

two slide rails, one attached to each of said struts, each of said slide rails extending along a length of said strut in a position adjacent said slide face, said slide rails engaging said slide rails of said lower ladder elements so as to allow said slide rails of said upper ladder elements to captively slide along said slide rails of said lower ladder elements;

a first and a second catch assembly, each of said catch assemblies comprising;

a yoke having a first and a second end. Said first end pivotally attached to one of said struts of said first upper ladder element, said second end formed to receive and hold said steps of said first lower ladder element; and a spring having a first end and a second end, said spring attached at said first end to said yoke and at said second end to said strut adjacent said yolk, said spring serving to bias said yoke to receive said steps of said first lower ladder element;

a third and a fourth catch assembly, each of said catch assemblies comprising;

a yoke having a first and a second end, said first end pivotally attached to one of said struts of said second upper ladder element, said second end formed to receive and hold said rungs of said second lower ladder element; and a spring having a first end and a second end, said spring attached at said first end to said yoke and at said second end to said strut adjacent said yolk, said spring serving to bias said yoke to receive said rungs of said second lower ladder element;

a first and a second bolt assembly, each of said bolt assemblies comprising;

a sliding bolt attached to one of said lower ladder elements in a position adjacent to said slide face of said lower ladder element; and a plurality of bolt tabs intermittently spaced along one of said upper ladder elements and positioned so as to receive said sliding bolt;

four foot pads, said foot pads attached one to a lower end of each of said struts of each of said lower ladder elements, said foot pads capable of being stepped upon in order to hold said lower ladder elements down while said upper ladder elements are being lifted; and a generally tabular hinge step rigidly attached to said first upper ladder element and pivotally attached to said second upper ladder element so as to allow said second upper ladder element and said second lower ladder element to fold between a position parallel and adjacent to said first upper ladder element and said first lower ladder element, and a position apart from said first upper ladder element and said first lower ladder element.

* * * * *